US006325896B1

(12) United States Patent
Hultcrantz et al.

(10) Patent No.: US 6,325,896 B1
(45) Date of Patent: Dec. 4, 2001

(54) APPARATUS FOR TRANSFERRING A FAST RUNNING FIBROUS WEB FROM A FIRST LOCATION TO A SECOND LOCATION

(75) Inventors: Lars-Magnus Hultcrantz, Deje; Å. Tomas Eklund, Karlstad; Robert D. Olsson, Forshaga, all of (SE)

(73) Assignee: Valmet-Karlstad AB, Karlstad (SE)

( * ) Notice: Subject to any disclaimer, the term of this patent is extended or adjusted under 35 U.S.C. 154(b) by 0 days.

(21) Appl. No.: 09/401,710

(22) Filed: Sep. 23, 1999

(51) Int. Cl.[7] ..... B65H 20/00

(52) U.S. Cl. ..... 162/289; 162/202; 162/193; 226/97.3

(58) Field of Search ..... 162/193, 194, 162/198, 199, 197, 202, 272, 281, 289, 363; 226/97.1, 97.2, 97.3, 7; 34/114, 120, 640, 641; 271/194, 195; 406/88, 89; 242/615.11, 615.12

(56) References Cited

U.S. PATENT DOCUMENTS

| | | | | |
|---|---|---|---|---|
| 3,587,177 | * | 6/1971 | Overly et al. | 34/641 |
| 3,650,043 | | 3/1972 | Overly et al. . | |
| 4,321,107 | | 3/1982 | Page . | |
| 4,881,327 | * | 11/1989 | Hauser et al. | 34/114 |
| 5,370,289 | | 12/1994 | Helms . | |
| 5,738,760 | | 4/1998 | Svanqvist et al. . | |
| 5,759,352 | | 6/1998 | Lau et al. . | |
| 5,803,448 | | 9/1998 | Stiel et al. . | |
| 5,891,309 | * | 4/1999 | Page et al. | 162/281 |
| 5,893,505 | * | 4/1999 | Mueller | 226/97.3 |
| 5,967,457 | | 10/1999 | Wildenberg et al. . | |
| 5,970,627 | | 10/1999 | Stenz et al. . | |

FOREIGN PATENT DOCUMENTS

| | | |
|---|---|---|
| WO 95/23754 A1 | 9/1995 | (WO) . |
| WO 99/29603 A1 | 6/1999 | (WO) . |

OTHER PUBLICATIONS

Fabio Perini, *Dry End & Converting*, Valmet, Tissue Making 1993, Sep. 16–17, pp. 87–104; Karlstad, Sweden.
A Sequa Company, Tissue Management Systems, 2000, pp. 1–4, Webline & Environmental Technologies, USA.

* cited by examiner

*Primary Examiner*—Peter Chin
*Assistant Examiner*—Eric Hug
(74) *Attorney, Agent, or Firm*—Alston & Bird LLP

(57) ABSTRACT

An apparatus for transferring a fast-running, ready-dried fibrous web from a first location to another with minimal undesirable motion is described. The apparatus includes an air foil defining a web support surface which extends substantially continuously from a first processing location to a second processing location, and includes at least two air supply channels extending substantially perpendicular to the direction of web travel across the air foil for providing flows of pressurized air between the foil and the web being, processed in the general direction of web travel. In this way, a layer of reduced static pressure is provided which stabilizes the web against undesirable motion, while the build up of dust is minimized.

36 Claims, 3 Drawing Sheets

APPARATUS FOR TRANSFERRING A FAST RUNNING FIBROUS WEB FROM A FIRST LOCATION TO A SECOND LOCATION

BACKGROUND OF THE INVENTION

1. Field of the Invention

The invention generally relates to an apparatus for transferring a fast running dried fibrous web from a first location to a second location along a predetermined pathway. More specifically, the invention relates to an apparatus for transferring fibrous sheets or webs, such as those made from paper, from a first location to a second location at improved levels of invariability and efficiency by minimizing, undesirable motion thereof.

2. Description of the Prior Art

The production of webs or sheets of material from a plurality of fibers at high rates of efficiency and uniformity can be very difficult. For example, in the production of paper products such as tissue, all phases of the production cycle, and in particular those at the dry end of the operation, must be performed at high levels of quality and invariability. As a result, each aspect of the process must be rigidly controlled to every extent possible.

Relatively fragile types of paper such as tissue present particular production problems for a variety of reasons. In a typical tissue making operation, the fibrous web is formed, then dried using a dryer such as a Yankee dryer (such terminology being familiar to those of ordinary skill in the art). The web is then removed from the dryer, such as by scraping it off of the dryer using a device such as a doctor blade, and transferred to the next processing stages (e.g generally calendering,, scanning and reel up). This point in the production cycle is therefore known as the "dry end", since the process steps at this point of the operation are performed on a dry web.

After removal from the dryer, the fibrous web is typically transported through a calender, where the web is pressed between a pair of rollers, and a scanner, where the web can be scanned for the presence of obvious defects as well as physical properties such as basis weight, moisture, and caliper. A slitter for slitting, the web longitudinally, usually into two halves of substantially the same width, may be provided downstream of the scanner. The web is then wound up on a reel for transport to a next operation such as cutting, of the web into smaller sections, etc.

It is at this dry end that a number of production inefficiencies are experienced, for a variety of reasons. For one, the dry end of the production cycle is a discontinuous process, as the doctor blade becomes worn and must be changed periodically. Similarly, defects formed in the paper, production errors, and the like can require that the operation be halted and begun again. Despite the discontinuous nature of the operation, in order to produce a high quality end product, it is important that the product produced remains uniform in its physical properties such as caliper, softness and stretch, as well as thickness and invariability.

The primary factors affecting dry end machine efficiency are lost time with no paper on the reel and the amount of paper rejected at paper breaks. On most high speed machines, the paper web roll is kicked out at a paper break because it is difficult to make a turn-up on a half or partial-size roll, and if the roll is small, it is generally rejected. Other items affecting the efficiency of the machine at the dry end are down time during, doctor blade changes, paper breaks, tail threading failures, turn-up failure, down-time for dry end cleaning (which is required to avoid web breaks caused by dust and dirt falling, down onto the web during processing), lost process control, and roll top and bottom waste. Roll bottom waste is caused by the radially inner paper web adjacent the reel spool having to be rejected, and roll top waste relates to the radially outer paper lost at the top of the web due to the kick out phase, and/or by taking samples for testing, and/or roll handling after the tissue machine.

In an efficiently operated machine, the threading of a new tail after doctor blade changes and web breaks does not take more than a few seconds. If the threader is out of adjustment, several minutes can be lost during each attempt to thread the new tail. In addition, paper may plug, the tail chutes, requiring time-consuming cleaning, of the whole dry end. Therefore, it is desirable to minimize the number of times the machine requires threading (for example, by minimizing the number of web breaks).

During, fast processing at the dry end, the webs or sheets of material have a tendency to experience undesirable motion which is commonly referred to as web flutter. As should be apparent to those of skill in the art, any motion which is uncontrolled has the ability to affect the quality and uniformity of the end product. Therefore. it is generally desirable to minimize such web flutter to the extent possible.

Prior web stabilizers or flutter suppressers are described in U.S. Pat. Nos. 4,321,107 to Page and 3,650,043 to Overly et al. However, heretofore, such devices have not been able to provide optimal amounts of flutter suppression while maintaining optimal processing speeds and conditions.

Another method for stabilizing a running web at the dry end is described in U.S. Pat. No. 5,738,760 to Svanqvist et al, the disclosure of which is incorporated herein by reference. The '760 patent describes a method of improving web transfer by providing a substantially web-wide support surface having, an upstream end and a shape conforming to at least a portion of that of the predetermined run of the web, with the support surface being located in a position adjacent to that of the predetermined run and extending from a first device to a subsequent device. The device described in the '760 patent is adapted to create a flow of air in the direction of the web run along the support surface by supplying pressurized air of a first pressure, e.g., from a fan, through a pipe member across the support surface in a cross-machine direction adjacent the upstream end of the support surface. A flow of air is also provided downstream of the first flow along, at least one further line across the support surface in a cross-machine direction. The flow of air forms between the web and the support surface an air layer of reduced static pressure, which serves to stabilize the web against flutter.

The apparatus described in the '760 patent uses a series of consecutive substantially web-wide plate members which define a substantially web-wide support surface having an upstream end and a shape conforming to at least a portion of that of the predetermined run between the two devices. The support surface is located in a position adjacent to that of the predetermined run and extends substantially all the way from the drying section to the reel up. Each of the plate members defining the substantially web-wide support surface has a leading edge and a trailing edge, and the trailing edge of at least one of the plate members is located spaced from and upstream of a leading, edge of an adjacent one of the plate members so as to form a plate assembly having a first slot-shaped gap between the plate members for the passage of air therethrough. The '760 patent describes that the apparatus includes a plurality of plate member assemblies, with each assembly having, an upstream edge and a downstream edge. The downstream edge of one assembly is located spaced from the upstream edge of an adjacent assembly so as to form a second slot-shaped gap between the assemblies for the passage of air therethrough. The patent describes that by permitting air to pass through the second slot-shaped gap, it is possible to maintain optimum web transfer conditions by supplying additional air through the pipe member of the subsequent plate member assembly. In order to remove dust from the system, the patent describes that the dust is removed through the second slot shaped gap by way of an air flow, the size of which is maximized by locating the downstream edge of one plate member assembly at a slightly larger distance from the predetermined run of the web than the distance of the upstream edge of the adjacent plate member assembly to the predetermined run of the web.

While the apparatus described in the '760 patent has enhanced the dry end processing of such fibrous materials, optimal processing results have yet to be achieved. In particular, the inventors of the apparatus which is the subject of the instant application have discovered that the vent gaps between the multiple plate members of the '760 apparatus tend to vacuum dust from the sheet and deliver it to the area above the plate members. The dust can build up and ultimately interfere with the operation of the machine. The amount of dust accumulated around the dry end of the machine varies dramatically depending on the type of fibers used, the basis weight of the web, the machine type, etc. Therefore, to ensure safe and efficient machine operation, the machine must be monitored to prevent dust build-ups, and dust must be cleaned away frequently.

In addition, the inventors of the instant invention have found that the air supply means (i.e., the pipe member and gap) of the device described in the '760 patent tended to become plugged with fiber, which in turn can interfere with the flow of air therethrough and which can allow the moving, sheet or web to fall away from the plate members. As will be appreciated by those of skill in the art, an improper orientation or positioning of the sheet or web relative to the processing apparatus can lead to the formation of defects in the end product or to interruptions in the processing operation as a result of sheet or web breakages. Therefore, the machine must be monitored for dust and fiber accumulation and cleaned frequently to prevent the build up of such materials and undesirable clogging of the air supply nozzles.

An active web stabilizer is disclosed in published PCT Appl. No. WO 99/29603 to Stenz, et al. An air nozzle is provided at the leading edge of the stabilizer and directs air flow first around a curved surface and then alone, a subsequent working surface. As illustrated in FIG. 6, multiple units of the active stabilizers can be closely spaced without touching in the machine direction such that spent air can leave through an exhaust passage between each of the adjoining units. As noted above, however, such an arrangement of multiple spaced units can cause dust to be exhausted through the gaps between adjoining units, thus creating the possibility of undesirable dust build-up.

Accordingly, a need exists for an apparatus which can minimize web flutter at the dry end of a fibrous web manufacturing operation, while enabling the web to be processed at desirable rates of efficiency and minimizing dust build-up.

SUMMARY OF THE INVENTION

These and other advantages are achieved in the present invention through the provision of a single air foil extending substantially continuously from a first upstream location to a second downstream location and defining a web support surface extending along at least a portion of the path which the web will take between the first and second locations. The air foil includes a plurality of air supply channels for providing pressurized air in the direction of web travel between the air foil and a web or sheet being transferred from the first location to the second location. As a result, a layer of air having reduced static pressure is formed between the web support surface of the air foil and the web being conveyed along the path between the two locations. In this way, the amount of undesirable motion (e.g., flutter) experienced by the web or sheet during transfer is vastly reduced.

It has been found by the instant inventors that by using a single air foil having plural air supply channels, the vent gaps used in prior art devices can be eliminated, thereby obviating the difficulties caused by the dust build-up associated with such vent gaps. In addition, the substantially continuous foil can be used to process relatively fragile fibrous products such as tissue in a rapid and efficient manner, as the air foil does not adversely impact the web itself.

In a preferred form of the invention, the air foil extends from a first processing device to a second processing device, and in particular, from the dryer (e.g., where a doctor blade removes the web from the dryer) to a calender or to a scanner. In particular, the air foil desirably extends along a major portion of a path between the two processing devices, and more preferably, it extends continuously along substantially the entire distance between the two devices, to provide continuous support for the web along, the full path between the first and second processing devices. As will be recognized by those of ordinary skill in the art, however, the air foil could be used at other positions along, the production operation where web support and flutter reduction would be desirable, either instead of the first position or in addition to the first position.

Where desired, the apparatus can also include an in-line threading device for automatically threading the web tail following machine stoppage or web breakage. Such threading devices are known by those having ordinary skill in the art, and may be particularly desired where the fibrous material to be processed is relatively fragile, since web breakages are generally more likely to occur during the processing of fragile materials. Air is fed to the foil of the instant invention at either the end or the top of the foil, although it is preferable that the air be fed to the foil of the instant invention from the end of the foil rather than the top, as this can tend to minimize the possibility of the production of a stagnant area in which dust can accumulate. Also, at least portions of the air foils are preferably made from stainless steel rather than aluminum (as used in conventional foils), since it has been found by the inventors that fiber has less of a tendency to build up on the bottom surface of the stainless steel foils than on the conventional aluminum devices. In addition, it is believed that stainless steel foils would be less likely to become damaged in the event of a dry end fire.

As a further enhancement over the devices of the prior art, the elements of the air foil of the instant invention are seal-welded together. In this way, water used during cleanup is kept from getting, inside the air foil, where it can subsequently drip out and cause breaks in a web being processed.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
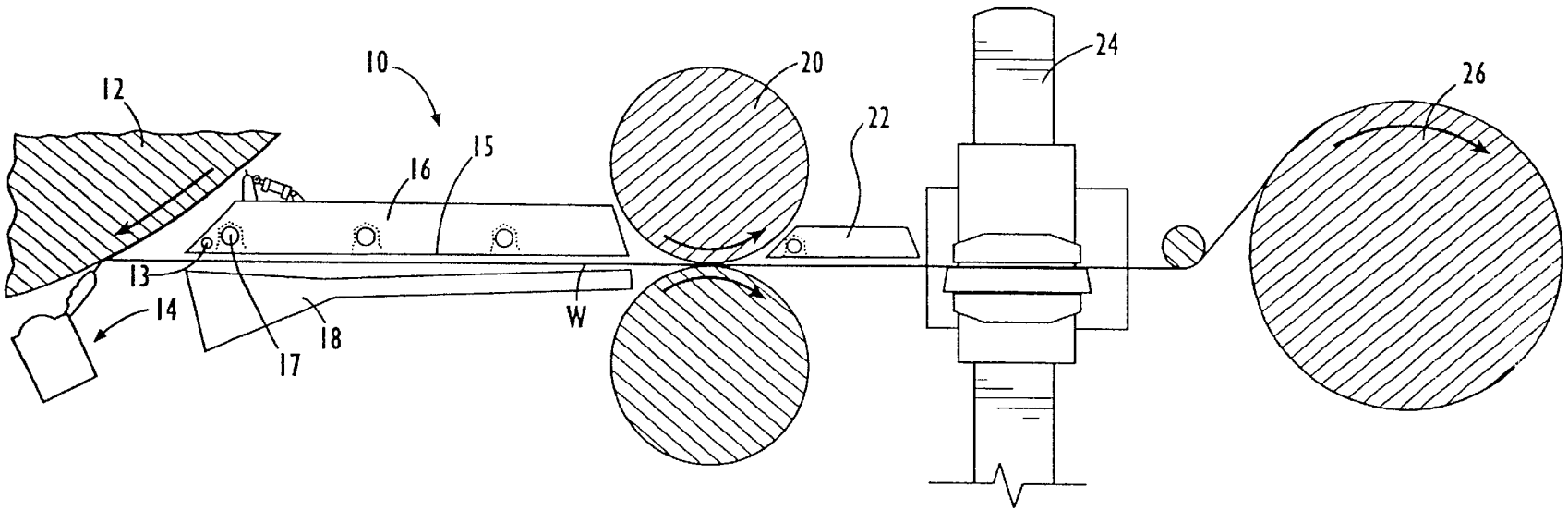
FIG. 1 is a schematic side elevational view of a dry end of a tissue paper making operation, illustrating a preferred location of the air foil of the instant invention.

With reference to the drawings, FIG. 1 illustrates a schematic representation of the dry end of a tissue papermaking apparatus, as shown generally at 10, incorporating an embodiment of an air foil according to the instant invention. Specifically, apparatus 10 transfers a tissue web W from a dryer 12 (in this illustration, a Yankee dryer) through a variety of processing devices and to a reel up device 26. (For purposes of this disclosure, the term "processing device" does not require that any physical transformation of the product take place, rather it refers to a device that a web may encounter during, the manufacturing, operation used to achieve a desired end product.) The web W is dried in a conventional manner on the Yankee dryer 12, then is removed from the dryer by way of a doctor blade 14, also in a conventional manner. Although for purposes of illustration the apparatus 10 includes a specific form of dryer and web removal device, it is noted that other forms of dryer and web removal devices can be used within the scope of the instant invention.

The web W then travels from a first location to a second location, which generally will correspond to first and second processing devices, to define a unidirectional path therebetween. In the illustrated embodiment, the web W travels adjacent the web support surface 15 of an air foil 16 made according to the instant invention, then desirably through a nip formed between a pair of calender rolls 20. However, the web W can travel to devices other than a calender depending on the particular web processing operation. Indeed, it is possible in some processes to omit a calender entirely.

Where desired, and particularly in situations where the processing devices are spaced such that an amount of web flutter is experienced between various processing devices, an additional air foil can be provided between two subsequent devices. For example, a second air foil 22 can be provided between the calender rolls 20 and the adjacent downstream device (which in the illustrated embodiment is a scanner 24), or between other downstream devices (e.g., between the scanner 24 and reel up 26.) In any event, a unidirectional path of travel is desirably defined between at least two devices, which is the path that a web takes as it is being processed.

As noted, a scanner 24 is desirably provided downstream of the calender 20. Such scanning equipment is known in the art, and can be used to scan and detect at least one physical property of the web being processed. For example, conventional scanner equipment may include a frame having a central opening for passage-through of the web, and a scanner unit for scanning one or more properties of the web. In some instances, the scanner may be movable back and forth across the web along the frame. In addition, the scanner can be positioned so that it is adjustable to any substantially horizontal web run. Furthermore, plural scanner heads may be provided for sensing different properties, such as basis weight, moisture content, etc. The scanner also desirably includes a surface for supporting the web during transfer through the device.

As illustrated, the web W passes adjacent an air foil 16 according to the instant invention, then to a subsequent processing device. The air foil 16 (as will be described more fully below) serves to reduce or even substantially eliminate flutter of the web as it is being transferred between the processing devices. To this end, the web support surface 15 of the air foil 16 is desirably at least as wide as or wider than the fibrous webs which it will be used to process. In this way, the web being, processed can be supported across its full widthwise dimension, and undesirable motion can be restrained across the entire dimension of the web. In addition, an air foil 16 is advantageously designed to begin and end as close as possible to the adjacent processing devices to provide greater sheet control. Although for purposes of clarity, the air foil 16 is illustrated as having the opposite ends spaced slightly from the processing devices, it will be understood that having, the greatest possible machine direction length for the air foil is usually most preferable.

The web W is then desirably wound on a reel up device 26. Such devices are known in the paper manufacturing art, and are designed to wind the web onto a carrier, for transport to another processing device or the like. Although not shown, it is noted that an additional air foil can be provided between the scanner and the reel up within the scope of the instant invention, the air foil being useful in providing stability to tile web during any region of the dry end process, and particularly those in which the processing devices are spaced from each other to any significant extent.

As illustrated and discussed in more detail below, the substantially continuous air foil 16 of the instant invention does not have gaps like that of the apparatus described in the '760 patent. Rather, the air foil 16 has a substantially continuous web support surface 15 and a plurality of air supply channels each for directing a stream of air in the general direction of web travel. The air supply channels each desirably extend across the web support surface in a direction generally perpendicular to the path of web travel. The air supply channels are illustrated and more specifically described in connection with FIGS. 2–4 below.

Figures 2, 3, 3A:
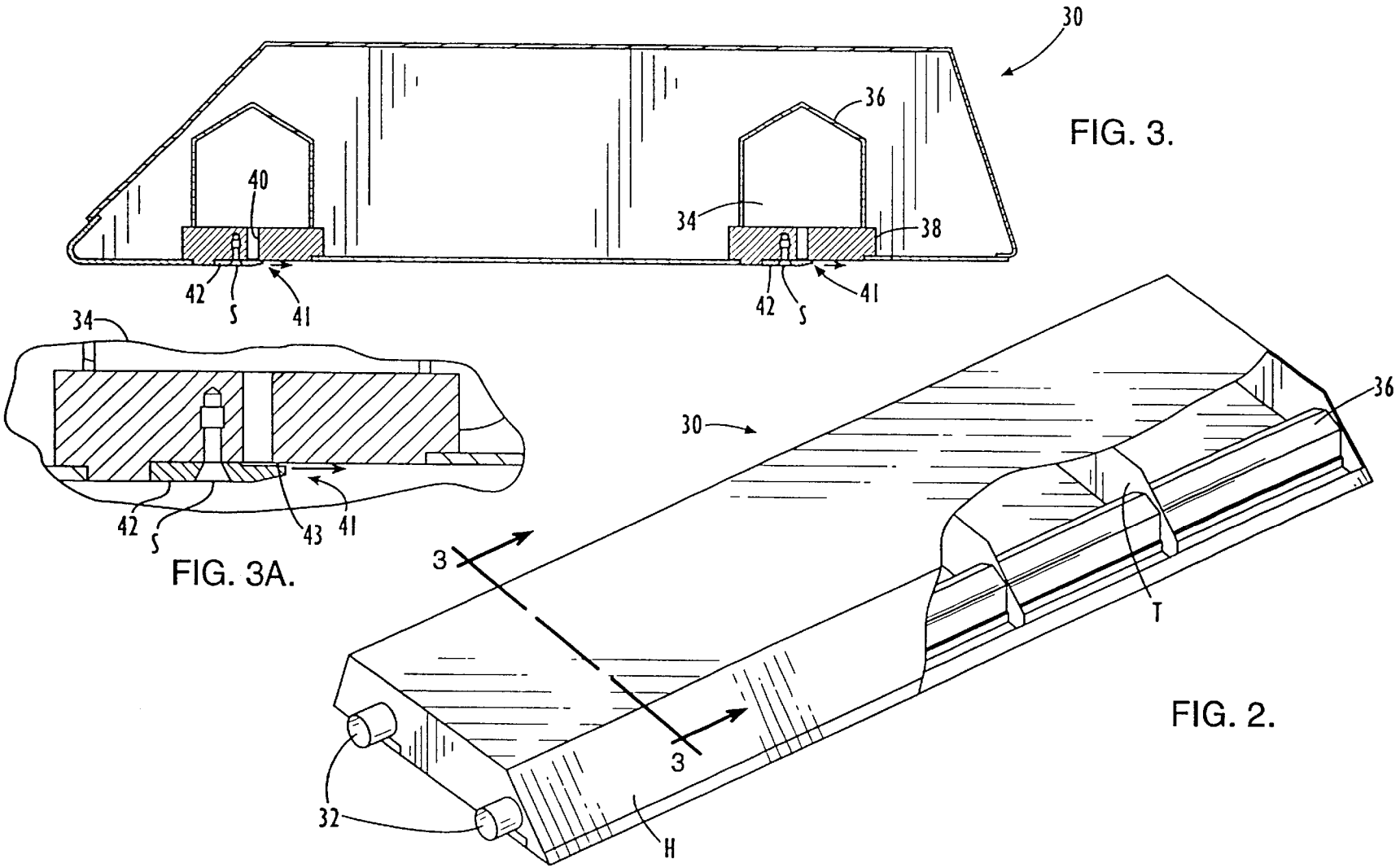
FIG. 2 is a perspective view of an air foil according to the instant invention, as it would appear with a portion of the top of the foil removed.
FIG. 3 is a cross-sectional view of an air foil of the instant invention, as taken along, line 3—3 of FIG. 2.
FIG. 3A is a greatly enlarged portion of FIG. 3 illustrating an air gap according to the invention.
Figure 4:
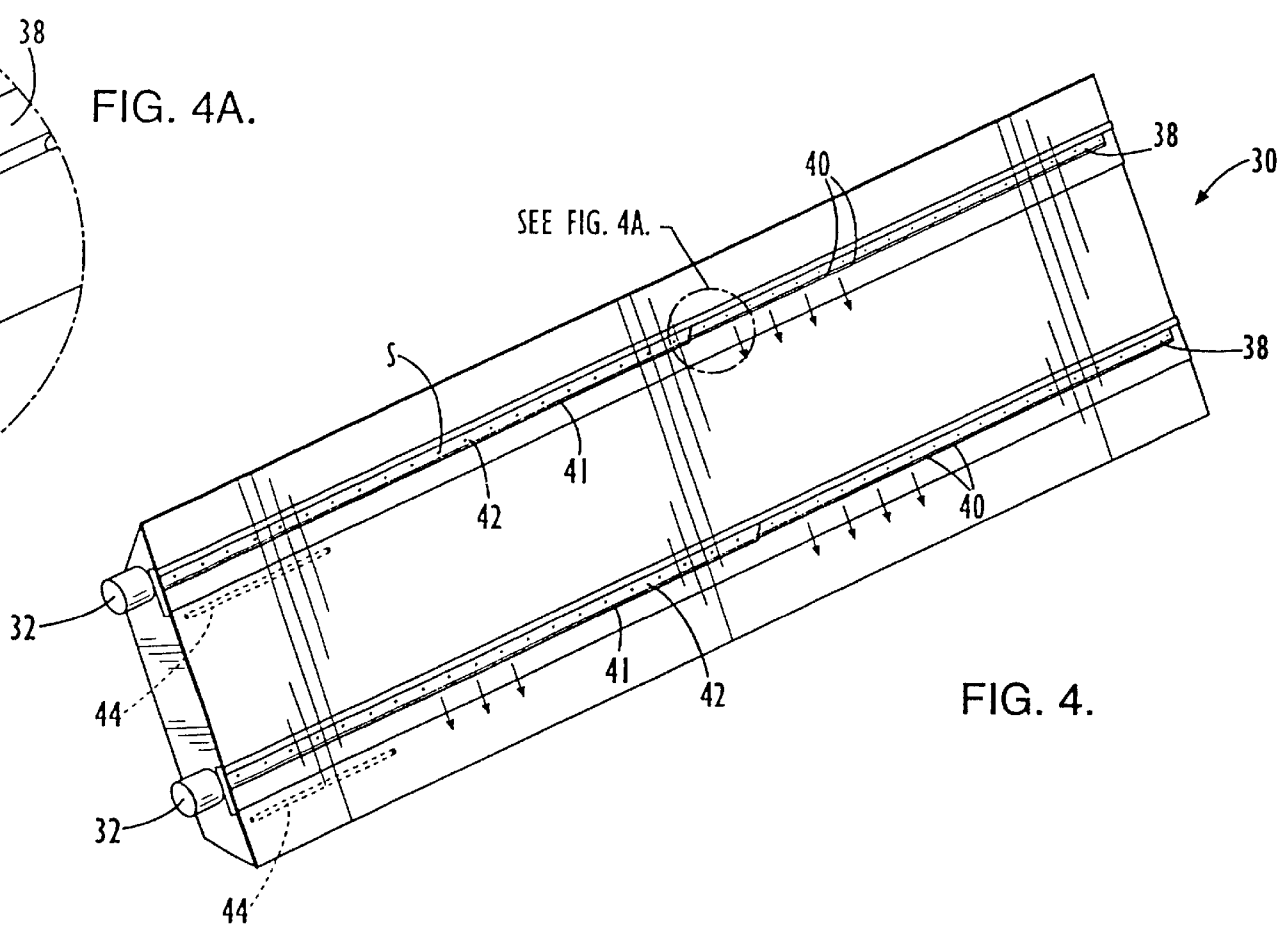
FIG. 4 is a perspective view of a lower surface (i.e., web supporting surface) of an air foil of the instant invention, as it would appear with a portion of the deflector bar removed.
Figure 4A:
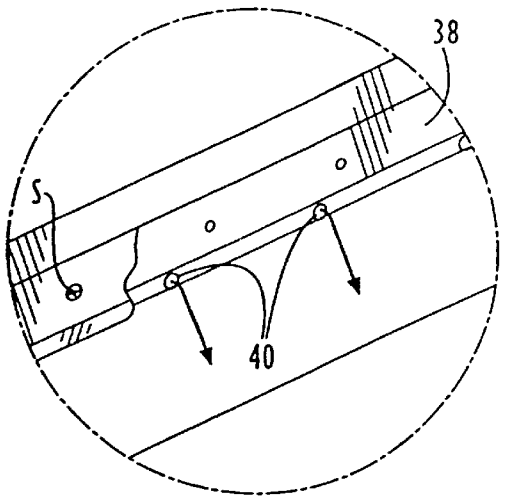
FIG. 4A is a greatly enlarged portion of FIG. 4.

The air foil 16 illustrated in FIG. 1 has three inlets 17 for the receipt of pressurized air from an air source (not shown), such as a compressor, a fan, or a blower, while the air foil 30 shown in FIGS. 2–4 has two inlets 32 and corresponding air supply channels 41. The air is received through the inlets 17, and is in turn ejected in the general direction of the path of web travel along, the bottom side of the web support surface 15 of tile air foil through air supply channels. A single air source may supply air to each of the inlets 17, or each inlet may be operatively associated with its own individual source of pressurized air. Preferably, but not necessarily, the air supply channels 41 are configured so that each blows air in substantially the same direction as the next one, and that the channels direct air in a single general direction, that being the general direction of web travel.

The apparatus 10 also desirably includes a guide channel 18 for receiving a tail end of a web coming from the doctor 14 and leading the end through the process and to the calender 20. To assist in directing the web W into the guide channel 18, a nozzle 13 can be provided for blowing a stream of air downwardly onto the web W and toward a broke pit or the like. Additional nozzles can be provided along the apparatus for supplying additional streams of air for directing the web into its desired position on the apparatus. For example, a nozzle (not shown) can be positioned on the doctor beam for blowing a tail end from the doctor blade into a converging throat of the guide channel for leading the guide end to and through the measuring frame and up to the calender. In addition, one or more dust removal apparatus may be provided to assist in keeping the machine clear of dust and debris. For example, one such dust removal apparatus which can be employed is described in U.S. Pat. No. 5,878,462, entitled "Dust Removal Apparatus", the disclosure of which is incorporated herein by reference.

FIGS. 2–4 illustrate more specifically a preferred embodiment of an air foil construction according to the instant invention. The air foil, shown generally at 30, has a housing, H having a top and sides. The air foil in this illustrated embodiment includes two pipe studs 32 (as opposed to three, as in the FIG. 1 embodiment) for receiving a flow of pressurized air from a conventional air supply source (not shown). The pipe studs 32, in a preferred form of the invention, feed into a side of the housing of the air foil, as it has been found that this orientation helps prevent the formation of regions of stagnant air which can exacerbate dust build-up. For example, the Yankee dryer entrains air, which carries dust in the area along the path of air flow. When the air flow is blocked such as by the supply tubes feeding the top of the foil, dust has a tendency to collect on the downstream sides of the tubes. By removing the tubes from the path of air flow, the corresponding problem of dust collection can be eliminated.

Each of the pipe studs 32 is operatively associated with a conduit 34, which in the illustrated embodiment is defined by an inverted channel bar 36 which is fixed to a flat bar 38. The channel bar 36, in a preferred embodiment of the invention, has a pointed top to form a conduit cross-section which is substantially house-shaped. It is noted that other shapes such as square or semi-round may be used within the scope of the invention. However, the substantially house-shaped cross-section has been found to be easy to fashion from metal sheets, is easy to weld, and tends to be more rigid than square-shaped channel bars. Furthermore, where the air foil has a sloping leading edge (such as shown in FIGS. 1 and 3), the sloping roof of the house shape enables it to be positioned very close to the leading, edge of the foil. The channel bar 36 and flat bar 38 are desirably sealed together in a manner to inhibit the ingress of water and other fluids through the seal, such as by seal welding, and permit the transfer of air from the pipe studs 32 across the width of the air foil, where it is released through air supply channels 41.

In this preferred embodiment of the invention, the bar 38 includes at least one opening, such as a bore or slit, and more preferably a plurality of spaced-apart openings 40, which are adapted to allow the egress of pressurized air from the adjacent conduit 34. In a preferred embodiment of the invention, the openings 40 are substantially cylindrical, and regularly spaced across the width of the bar 38. However, other opening shapes can be used within the scope of the invention, and the spacing can be irregular or in a pattern where so desired. Furthermore, while single openings are shown, it is also within the scope of the invention to use plural openings in the machine direction where single openings are shown. The openings 40 are in turn at least partially and preferably entirely covered by a deflector 42 which forms, at its trailing, edge, a small air discharge gap 43 which functions as the air supply channel 41. This air supply channel 41 provides a flow of air in the general direction of the unidirectional web path and in the general plane of the web support surface. Although other materials can be used, in a preferred form of the invention, the flat bar is made of steel (and more preferably, stainless steel), and the deflector bar is fastened to the bar by way of screws S. However, as will be appreciated by those of ordinary skill in the art, other forms of attachment may be used within the scope of the instant invention, provided they offer a secure attachment between the various parts of the apparatus.

Preferably, the openings 40 have a diameter of about 5 to about 15 mm, and the air discharge gap 43 formed between the bar and the deflector is about 0.02 mm to about 1 mm in size. In a particularly preferred embodiment of the invention, the openings 40 have a diameter of about 10 mm (0.39 inch) and the air discharge gap 43 formed between the bar and the deflector bar is about 0.1 mm (3.9 mils) in size. It is noted, however, that other sizes of openings and discharge gaps can be used within the scope of the instant invention, the optimal sizes being dependent on such things as the size of the machine, the thickness and durability of the webs to be processed, the speed at which the machine is to be run, etc. In addition, while the deflector 42 is illustrated as being a continuous bar, it is noted that the deflector could be segmented or otherwise shaped, within the scope of the instant invention. Furthermore, the dimension of the air discharge clap 43 can be constructed so as to be adjustable, for example, by adjusting the screws to secure the deflector 42 at a smaller or greater distance from the bar 38 by way of shims, for example. Although the length of the deflector 42 which extends beyond the openings 40 can be selected to achieve optimal results for the particular machine and web which the machine will be used to process, it desirably extends beyond the opening 40 about 2–10 mm, and more preferably about 5 mm (0.2 inches). In addition, the openings 40 and any edges of the walls of the discharge gap 43 can be provided with chamfered edges to improve airflow if desired.

Also, it is to be recognized that other numbers of air inlets and air supply channels can be used within the scope of the invention, the optimal number being dependent on the type and size of machine being used, the physical properties of the material to be transferred by the apparatus, and the like. In addition, supports T can be provided (see FIG. 2), to assist in securing, all of the elements of the air foil together and maintaining the elements in their proper orientation during machine operation. Furthermore, it is noted that while conduits 34 have been illustrated in the drawings as being substantially straight, other configurations could be used, such as those which are curved or angularly bent. In this way, an angular or curved shape can be used to provide a lateral component to the air discharge in the general direction of the web movement to assist in removing wrinkles from the web. Also, it is noted that a single inlet can be used to supply air, or the air can be supplied from each end of the conduit. In such embodiments where the air is provided from both ends of the conduit, the conduit can include an internal wall, to thereby divide the conduit into a tender side portion and drive side portion, with the two portions being divided from communication with each other.

The air foil 30 may also include one or more relatively shorter slots 44, as shown in dashed lines alongy one side of the foil in FIG. 4, along the side edges of the web support surface for providing a flow of air to assist in the threading of the tail of the web within the machine. In this case, a primary air system (e.g. a fan, blower, or the like) will be used to supply air at a first pressure (e.g, about 120 kilopascals) while a secondary air system supplies air at a greater pressure (e.g., an absolute pressure of about 150 to 200 kilopascals), which is provided for pneumatically conveying a web tail. Other types of in-line tail threading devices may be used within the scope of the instant invention such as that provided in the Svanqvist, et al. '760 patent, or the apparatus may be formed without provisions for in-line threading.

In operation of the apparatus illustrated in the drawings, pressurized air is fed by way of the pipe studs 32 into the air conduits 34, where it is ejected in the general direction of web travel out through the air supply channel 41. In a preferred form of the invention, air is provided by one or more air sources (not shown) to the pipe studs 32 and into the air conduits 34, where it flows through the openings 40 in the bar 38, then out through the air discharge (lap 43 formed between the bar and the deflector 42. As illustrated, the openings extend in a direction generally transverse to the direction of web travel, and the deflector modifies the direction of the air flow as it exits the openings. In this way, air is directed in the direction of web travel, and a layer of pressurized air is provided between the air foil 30 and the web W. which decreases the tendency of the web to flutter undesirably. The web is therefore stabilized against undesirable motion, while rapid processing can be achieved. Furthermore, the apparatus of the instant invention has been found to avoid the undesirable accumulation of dust and the like experienced by other apparatus.

As noted above, the elements forming the air foil are desirably secured together in a manner which will at least minimize, and preferably prohibit entirely, the ingress of liquids to the foil interior. For example, the elements can be seal welded in a maimer which prevents water from entering the foil; in this way, the foils can be easily cleaned without fear of water from the cleaning process subsequently dripping out of the foil and damaging, a web being processed. In addition, it is desirable that stainless steel is used to form the air foil, and in particular those elements forming the web support surface, since stainless steel appears to experience dust build-up to a lesser extent than aluminum and because it is believed that stainless steel would withstand a dry end fire better than would aluminum.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for processing a moving fibrous web in a paper machine comprising:

a first device for processing a fibrous web;

a second device for processing a fibrous web positioned downstream of said first processing device, said first and second devices defining a unidirectional path of travel for a fibrous web therebetween; and an air foil extending, between said first and second devices, said air foil including a substantially continuous web support surface extending substantially the entire distance of the path of travel between said first and second devices and a defining a first air supply channel extending across the web support surface in a direction generally perpendicular to said unidirectional path of travel, and a second air supply channel located downstream of said first air supply channel and extending across the web support surface in a direction generally perpendicular to said unidirectional path of travel, and said first and second air supply channels each being, adapted to provide a flow of air in the direction of the unidirectional path of travel, so as to provide a layer of air having a reduced static pressure along said substantially continuous web support surface.

2. An apparatus according to claim 1, wherein said air foil comprises at least three air supply channels.

3. An apparatus according to claim 1, further comprising an air source operatively associated with each of said air supply channels for providing a flow of pressurized air thereto.

4. An apparatus according to claim 1, further comprising a separate air source operatively associated with each of said air supply channels.

5. An apparatus according to claim 1, wherein each of said air supply channels comprises at least one opening located proximate said web support surface which is operatively associated with an air supply conduit, with each of said air supply conduits being adapted to transport pressurized air to the associated at least one opening.

6. An apparatus according to claim 5, wherein said air supply channels each comprise a plurality of spaced apart openings.

7. An apparatus according to claim 6, wherein said plurality of spaced apart openings are regularly spaced from each other to provide a generally uniform flow of air across the web support surface.

8. An apparatus according to claim 5, further comprising a deflector covering at least a portion of said at least one opening of each of said air supply channels for affecting the output direction of a flow of air through the at least one opening.

9. An apparatus according to claim 8, wherein said deflector is spaced from the exit end of each of said at least one opening to define an air discharge gap for directing air in a direction substantially parallel with said web support surface.

10. An apparatus according to claim 9, wherein said air discharge gap is about 0.1 mm in size.

11. An apparatus according to claim 5, wherein each opening is generally cylindrical and has a diameter of about 10 mm.

12. An apparatus according to claim 1, wherein said air foil includes a housing secured to the web support surface, said housing, having a top and a plurality of sides, and further comprising an air source operatively connected to at least one of said sides of the housing.

13. An apparatus according to claim 1, wherein at least a portion of said air foil is made from stainless steel.

14. An apparatus according to claim 1, wherein elements forming said air foil are sealed together in a manner designed to prohibit entry of liquids into the interior of the air foil.

15. An apparatus according to claim 1, wherein said first apparatus comprises a doctor blade and said second apparatus comprises a calender.

16. An apparatus according to claim 1, wherein said first apparatus comprises a calender and said second apparatus comprises a scanning apparatus.

17. An apparatus according to claim 1, wherein said first apparatus comprises a scanning apparatus and said second apparatus comprises a reel up.

18. An apparatus for processing a moving fibrous web in a paper machine comprising:

a first device for processing a fibrous web;

a second device for processing a fibrous web positioned downstream of said first processing device, said first and second devices defining a unidirectional path of travel for a fibrous web therebetween;

an air foil extending between said first and second devices, said air foil including, a substantially continuous web support surface extending along at least a major portion of said unidirectional path of travel, and said web support surface defining a first air supply channel extending across the web support surface in a direction generally perpendicular to said unidirectional path of travel, and a second air supply channel located downstream of said first air supply channel and extending across the web support surface in a direction generally perpendicular to said unidirectional path of travel, and said first and second air supply channels each being adapted to provide a flow of air in the direction of the unidirectional path of travel, so as to provide a layer of air having a reduced static pressure alone, said substantially continuous web support surface, wherein each of said air supply channels comprises at least one opening, located proximate said web support surface which is operatively associated with an air supply conduit, with each of said air supply conduits being, adapted to transport pressurized air to the associated at least one opening; and a deflector covering, at least a portion of said at least one opening of each of said air supply channels for affecting a the output direction of a flow of air through the at least one opening, wherein said deflector is in the form of an elongate bar.

19. An apparatus for processing a moving fibrous web in a paper machine comprising:

a first device for processing a fibrous web;

a second device for processing a fibrous web positioned downstream of said first processing device, said first and second devices defining a unidirectional path of travel for a fibrous web therebetween;

an air foil extending between said first and second devices, said air foil including a substantially continuous web support surface extending along at least a major portion of said unidirectional path of travel, and said web support surface defining a first air supply channel extending, across the web support surface in a direction generally perpendicular to said unidirectional path of travel, and a second air supply channel located downstream of said first air supply channel and extending across the web support surface in a direction generally perpendicular to said unidirectional path of travel, and said first and second air supply channels each being adapted to provide a flow of air in the direction of the unidirectional path of travel, so as to provide a layer of air having, a reduced static pressure along said substantially continuous web support surface, wherein each of said air supply channels comprises at least one opening, located proximate said web support surface which is operatively associated with an air supply conduit, with each of said air supply conduits being adapted to transport pressurized air to the associated at least one opening; and a deflector covering at least a portion of said at least one opening of each of said air supply channels for affecting the output direction of a flow of air through the at least one opening, wherein said deflector extends beyond said at least one opening about 5 min in the direction of the path of travel of the web.

20. An apparatus for processing a moving fibrous web in a paper machine comprising:

a first device for processing a fibrous web;

a second device for processing a fibrous web positioned downstream of said first processing device, said first and second devices defining a unidirectional path of travel for a fibrous web therebetween;

an air foil extending between said first and second devices, said air foil including a substantially continuous web support surface extending along at least a major portion of said unidirectional path of travel, and said web support surface defining, a first air supply channel extending across the web support surface in a direction generally perpendicular to said unidirectional path of travel, and a second air supply channel located downstream of said first air supply channel and extending across the web support surface in a direction generally perpendicular to said unidirectional path of travel, and said first and second air supply channels each being adapted to provide a flow of air in the direction of the unidirectional path of travel, so as to provide a layer of air having a reduced static pressure along said substantially continuous web support surface; and additional air supply channels extending along, side portions of said web support surface, said additional air supply channels being, adapted to assist in threading of a tail of a web being processed through the apparatus.

21. An apparatus for stabilizing motion of a fast-running fibrous web during processing through a plurality of processing devices, comprising:

an air foil having, a substantially continuous surface extending from a first upstream location to a second downstream location to define a web support surface along a path of web travel from said upstream location to said downstream location, said web support surface including a first air supply channel extending in a direction generally perpendicular to the path of web travel, and a second air supply channel extending in a direction generally perpendicular to said path of web travel and at a position on said web support surface downstream from said first air supply channel, wherein each of said first and second air supply channels includes a conduit for transporting air provided across the width of said web support surface, and wherein each of said air supply channels includes a bar having a plurality of openings therein operatively associated with the conduit; and a deflector secured to said air foil proximate the bar of each of said air supply channels, said deflector covering at least a portion of said plurality of openings of the bar of each of said air supply channels to provide first and second flows of air toward a downstream direction to create a layer of air having reduced static pressure adjacent said web support surface.

22. An apparatus according to claim 21, further comprising at least one additional air supply channel extending in a direction generally perpendicular to said path of web travel, said at least one additional air supply channel being, adapted to provide a flow of air toward a downstream direction.

23. An apparatus according to claim 21, wherein each of said first and second air supply channels is operatively associated with a separate air supply source.

24. An apparatus according to claim 21, wherein said first upstream location is located substantially adjacent a first processing device and said second downstream location is located substantially adjacent a second processing device, such that said support surface provides substantially continuous support for a web traveling between the first and second processing devices.

25. An apparatus according to claim 21, wherein said air foil comprises stainless steel.

26. An apparatus according to claim 21, wherein elements forming said air foil are sealed together in a manner designed to prohibit entry of liquids into the interior of the air foil.

27. An apparatus for stabilizing motion of a fast-running fibrous web during processing through a plurality of processing devices, comprising:

an air foil having a substantially continuous surface extending from a first upstream location to a second downstream location to define a web support surface along a path of web travel from said upstream location to said downstream location, said web support surface including a first air supply channel extending in a direction generally perpendicular to the path of web travel, and a second air supply channel extending in a direction generally perpendicular to said path of web travel and at a position on said web support surface downstream from said first air supply channel, wherein each of said first and second air supply channels includes a conduit for transporting air provided across the width of said web support surface, said first and second air supply channels being adapted to provide first and second flows of air toward a downstream direction to create a layer of air having, reduced static pressure adjacent said web support surface, wherein said air foil further comprises additional air supply channels for assisting in the threading of a tall of a web being processed through the apparatus.

28. An apparatus for transferring a dried fibrous web along a predetermined path between first and second locations comprising:

a web transfer device having, a substantially continuous web support surface having, an upstream end and a shape conforming to at least a portion of a unidirectional path defined between a first processing location and a second processing location, and said web support surface having an air supply channel including a bar defining at least one opening extending substantially transverse to the plane of the web support surface, and a deflector secured to the bar and covering at least a portion of said at least one opening for directing an air flow exiting, said at least one opening in a direction generally parallel to said web support surface.

29. An apparatus according to claim 28, wherein the deflector is adjustably secured to the bar.

30. An apparatus according to claim 28, wherein said air supply channel includes a plurality of spaced apart openings.

31. An apparatus according to claim 30, wherein each of said openings has a diameter of about 10 mm.

32. An apparatus according to claim 28, wherein said deflector is spaced from the exit end of each of said at least one opening to define an air discharge gap for directing air in a direction substantially parallel to the web support surface.

33. An apparatus according to claim 32, wherein said air discharge gap is about 0.1 mm in size.

34. An apparatus for transferring a dried fibrous web along a predetermined path between first and second locations comprising:

a web transfer device having, a substantially continuous web support surface having, an upstream end and a shape conforming to at least a portion of a unidirectional path defined between a first processing location and a second processing location, and said web support surface having an air supply channel including at least one opening extending substantially transverse to the plane of the web support surface, and a deflector covering at least a portion of said at least one opening for directing an air flow exiting said at least one opening in a direction generally parallel to said web support surface, wherein said deflector is recessed into said web transfer device to define a smooth transition from the web support surface to the deflector in the direction of the path of the fibrous web.

35. An apparatus for transferring a dried fibrous web along a predetermined path between first and second locations comprising:

a web transfer device having a substantially continuous web support surface having, an upstream end and a shape conforming to at least a portion of a unidirectional path defined between a first processing location and a second processing location, and said web support surface having an air supply channel including at least one opening extending, substantially transverse to the plane of the web support surface, and a deflector covering at least a portion of said at least one opening for directing an air flow exiting said at least one opening, in a direction generally parallel to said web support surface, wherein said deflector extends beyond said at least one opening, about 5 mm in a downstream direction along said unidirectional path.

36. An apparatus for stabilizing a traveling web, comprising:

an air foil defining a substantially continuous web support surface extending from a first upstream location to a second downstream location along a path of travel of the web, the air foil including a first air supply channel proximate the first location and a second air supply channel proximate the second location, each air supply channel extending generally perpendicular to a direction along which the web travels;

means for discharging air from each air supply channel in a direction generally transverse to a plane defined by the web; and means for re-directing the air discharged by said means for discharging, air such that the air is forced to travel generally in the direction of travel of the web so as to create a reduced-pressure ie,,ion between the web and the web support surface.

* * * * *

UNITED STATES PATENT AND TRADEMARK OFFICE

CERTIFICATE OF CORRECTION

PATENT NO. : 6,325,896 B1
DATED : December 4, 2001
INVENTOR(S) : Hultcrantz et al.

It is certified that error appears in the above-identified patent and that said Letters Patent is hereby corrected as shown below:

Title page,
Item [57], ABSTRACT,
Line 9, after “being” cancel the comma (,).

Column 10,
Line 3, after “extending” cancel the comma (,);
Line 15, after “being” cancel the comma (,);
Line 59, after “housing” cancel the comma (,).

Column 11,
Line 19, after “including” cancel the comma (,);
Line 33, “alone,” should read -- along --;
Line 36, after “opening” cancel the comma (,);
Line 39, after “being” cancel the comma (,);
Line 41, after “covering” cancel the comma (,);
Line 43, cancel “a” (first occurrence);
Line 59, after “extending” cancel the comma (,).

Column 12,
Line 2, after “having” cancel the comma (,);
Line 5, after “opening” cancel the comma (,);
Line 14, “5 min” should read -- 5mm --;
Line 28, after “defining” cancel the comma (,);
Line 41, after “along” cancel the comma (,);
Line 43, after “being” cancel the comma (,);
Line 48, after “having” cancel the comma (,).

UNITED STATES PATENT AND TRADEMARK OFFICE

CERTIFICATE OF CORRECTION

PATENT NO. : 6,325,896 B1
DATED : December 4, 2001
INVENTOR(S) : Hultcrantz et al.

It is certified that error appears in the above-identified patent and that said Letters Patent is hereby corrected as shown below:

Column 13,
Line 8, after “being” cancel the comma (,);
Line 46, after “having” cancel the comma (,);
Line 49, “tall” should read -- tail --;
Lines 54 and 55, after “having” cancel the comma (,);
Line 63, after “exiting” cancel the comma (,).

Column 14,
Lines 16, 17 and 36, after “having” cancel the comma (,);
Line 41, after “extending” cancel the comma (,);
Lines 45 and 47, after “opening” cancel the comma (,);
Line 62, after “discharging” cancel the comma (,);
Line 64, “ie,,ion” should read -- region --.

Signed and Sealed this

Fourth Day of June, 2002

*Attest:*

*Attesting Officer*

JAMES E. ROGAN
*Director of the United States Patent and Trademark Office*